United States Patent [19]

Kirayoglu et al.

[11] 4,442,161

[45] Apr. 10, 1984

[54] WOODPULP-POLYESTER SPUNLACED FABRICS

[75] Inventors: Birol Kirayoglu, Wilmington; Dimitri P. Zafiroglu, Newark, both of Del.

[73] Assignee: E. I. Du Pont de Nemours and Company, Wilmington, Del.

[21] Appl. No.: 439,209

[22] Filed: Nov. 4, 1982

[51] Int. Cl.[3] ..... D04N 1/46

[52] U.S. Cl. ..... 428/219; 28/104; 28/105; 428/220; 428/227; 428/288; 428/326; 428/340

[58] Field of Search ..... 28/104, 105; 428/227, 428/326, 340, 219, 220, 288

[56] References Cited

U.S. PATENT DOCUMENTS

| | | | |
|---|---|---|---|
| 3,403,862 | 10/1968 | Dworjanyn | 239/566 |
| 3,493,462 | 2/1970 | Bunting et al. | 161/169 |
| 3,508,308 | 4/1970 | Bunting et al. | 28/72.2 |
| 3,560,326 | 2/1971 | Bunting et al. | 161/169 |
| 3,620,903 | 11/1971 | Bunting et al. | 161/169 |
| 4,069,563 | 1/1978 | Contractor et al. | 28/105 |

FOREIGN PATENT DOCUMENTS

| | | | |
|---|---|---|---|
| 841938 | 5/1970 | Canada | 92/11 |

OTHER PUBLICATIONS

*Research Disclosure,* 17060 (Jun. 1978), p. 50, "Composite of Synthetic-Fiber Web and Paper," E. I. du Pont de Nemours & Co.

*Primary Examiner*—James J. Bell

[57] ABSTRACT

Improved liquid-barrier properties are provided to spunlaced fabrics of woodpulp and synthetic organic fibers by employing closely spaced jets in a hydraulic entanglement treatment of the fibers. Additional improvement in barrier properties is provided by a finishing step which employs multiple passes under low pressure, closely spaced jets.

10 Claims, 2 Drawing Figures

WOODPULP-POLYESTER SPUNLACED FABRICS

BACKGROUND OF THE INVENTION

1. Field of the Invention

This invention relates to a nonapertured spunlaced fabric made from woodpulp and synthetic organic fibers. More particularly, the invention concerns an improved process for hydraulically entangling such fibers and the novel spunlaced fabric of improved liquid-barrier characteristics produced thereby.

2. Description of the Prior Art

Spunlaced fabrics are strong, stable nonwoven fabrics which are made by subjecting assemblies of fibers to fine columnar jets of water, as disclosed, for example, by Bunting, Evans and Hook in U.S. Pat. Nos. 3,493,462, 3,508,308, 3,560,326 and 3,620,903. These patents disclose several specific spunlaced fabrics made from assemblies of woodpulp and polyester fibers. Examples 9 and 10 of U.S. Pat. No. 3,620,903 and Examples 4 and 5 of U.S. Pat. No. 3,560,326 describe spunlaced fabrics made from assemblies of polyester staple-fiber webs and tissue-grade woodpulp-fiber paper, wherein the woodpulp-to-polyester weight ratios range from 33:67 to 75:35. Examples 13 and XIII of U.S. Pat. Nos. 3,493,402 and 3,508,308, respectively, disclose spunlaced fabrics made from assembles of kraft paper and nonbonded, continuous polyester filament webs. The use of bonded, polyester filament webs in such spunlaced fabrics is suggested by Shambelan, Canadian Pat. No. 841,938 and by Research Disclosure No., 17060, June 1978.

Spunlaced fabrics of woodpulp and polyester staple fibers have also been available commercially, as Sontara® sold by E. I. du Pont de Nemours and Company, Wilmington, Del. USA. Such a commercial fabric and its manufacture are described in Example 2 (Comparison). The fabrics have been made into surgeons' gowns and patients' drapes for use in hospital operating rooms. An important function of the fabric is to provide a barrier to the passage of liquid and inhibit the migration of liquid-borne bacteria through the fabrics.

In manufacturing woodpulp-polyester spunlaced fabrics in the past, the streams of water are jetted from orifices of 0.002 to 0.015 inch (0.051 to 0.381 mm) in diameter, located a short distance, usually about one inch (2.5 cm) above the surface of the fiber assembly. The orifices are spaced to produce at least 10, but preferably 30 to 50, jets per inch width of fiber assembly being treated (3.9 jets per cm, preferably 11.8 to 19.7). In practice, 0.005-inch (0.127-mm) diameter orifices and 40 jets per inch (15.7/cm) are commonly used. Orifices are usually supplied with water at pressures of more than 200 psi (1380 kPa) but no more than 2000 psi (13,790 kPa). The water jets subject the fiber assembly to an energy flux of at least 23,000 ft-poundals/in$^2$-sec (9000 J/cm$^2$ min) and a total energy of at least 0.1 horsepower-hour per pound ($0.59\times10^6$ J/kg) of fabric. Sufficient energy and impact are supplied by the jets to entangle the fibers and form them into the spunlaced fabric. The entanglement treatment is performed while the fiber assembly is supported on a fine mesh screen, an apertured plate, a solid member or the like. The treatment is performed so that the resultant fabric is not apertured and appears not to be patterned, but may have a repeating pattern of closely spaced lines of fiber entanglement, called "jet tracks", which are visible under magnification.

Orifices for use in the above-described process are disclosed by Dworjanyn, U.S. Pat. No. 3,403,862 and their arrangement in staggered rows is disclosed by Contractor and Kirayoglu, U.S. Pat. No. 4,069,563. The degree of fiber entanglement produced by the process generally is proportional to the product of E times I, where E is the energy of a jet treating the fiber assembly and I is the impact force of a jet on the fiber assembly. The usual units of the energy-impact product, E×I, are horsepower-hour per pound mass multiplied by pounds force (Hp-hr. $lb_f/lb_m$), which when multiplied by $2.63\times10^7$, are converted to Joules per kilogram multiplied by Newtons (JN/kg). The E×I used in a pass of a fiber assembly under a row of jets is related to process and orifice variables by the following formula:

$$E\times I=kP^{2.5}d^4n/bS$$

where k is a constant that depends on the units of the variables, P is the supply pressure immediately upstream of the orifice, d is the orifice diameter, n is the jet spacing in numer of jets per unit width of fiber assembly being treated, b is the weight of the fiber assembly per unit surface area, and S is the speed of the fiber assembly under the jets. The total E×I of the process is the summation of the E×I of the jets during each pass of the fiber assembly under the jets.

Although the above-described nonapertured spunlaced fabrics of woodpulp and polyester fibers have generally performed satisfactorily in hospital drapes and gowns, the utility of the fabrics could be enhanced significantly by improvements in their liquid barrier properties. The purpose of the present invention is to provide such a spunlaced fabric with increased liquid-barrier properties.

SUMMARY OF THE INVENTION

The present invention provides an improved process for producing a nonapertured, spunlaced nonwoven fabric. The process is of the type wherein an assembly consisting essentially of woodpulp and synthetic organic fibers, while on a supporting member, is treated with fine columnar jets of water which issue from banks of orifices having diameters in the range of 0.05 to 0.13 millimeters (0.002 to 0.005 inch) of orifices and provide a sufficient total energy-impact product (E×I) to entangle the fibers and form them into the spunlaced fabric. The improvement of the present invention is based on the discovery that increased liquid-barrier characteristics can be imparted to these spunlaced fabrics by preparing the fabrics with hydraulic jets that are more closely spaced than heretofore.

In one embodiment of the process of the invention, the improvement comprises performing the hydraulic jet treatment with at least one third of the total energy-impact product (E×I) being furnished through orifice banks which provide at least 23 jets per centimeter (58.4/in) width of fiber assembly being treated and preferably operate with orifice supply pressures of at least 6900 kPa (1000 psi). Preferably, jet spacings of at least 27 jets/cm (68.6/in) are used, but spacings in the range of 30 to 50 jets/cm (76 to 127/in) are most preferred.

In another embodiment of the process of the invention, the liquid-barrier characteristics of the spunlaced fabrics are increased by following the known hydraulic entanglement treatment with a finishing step that employs hydraulic jets which add no more than two percent to the total E×I, have supply pressures of less than 1720 kPa (250 psi), usually in the range of 345 to 1035 kPa (50 to 150 psi) and have spacings of at least 27 jets/cm (68.6/in). Most preferably, the finishing step adds less than one percent to the total E×I and is performed with a plurality of orifice banks having jet spacings in the range of 30 to 50 jets/cm (76 to 127/in).

In another preferred embodiment of the process of the invention, the improvement comprises following the above-described improved entanglement treatment with the above-described finishing step.

For preparing the fiber assembly of the process of the present invention, it is preferred that the synthetic organic fibers be in the form of continuous filament nonwoven sheet and the woodpulp fibers be in the form of paper sheet.

The invention also provides a novel, improved, nonapertured, spunlaced nonwoven fabric consisting essentially of woodpulp and synthetic organic fibers. Such a fabric, for use in hospital gowns and drapes, generally has a unit weight of less than about 75 g/m$^2$ (2.2 oz/yd$^2$). The improved fabric of the invention is characterized by a hydrostatic head of at least 23 cm, preferably of at least 26 cm, and by at least 23 jet tracks per centimeter (58.4/in), usually at least 27 cm (68.6/in), and preferably 30 to 50/cm (76 to 127/in).

BRIEF DESCRIPTION OF THE DRAWINGS

In the description and examples which follow, the invention is illustrated with polyester fibers. However, fibers of other synthetic organic polymers are also useful. Among these other polymers are polypropylene, nylon, acrylics and the like.

The invention will be more readily understood by reference to the accompanying drawings in which the effects of the use of closely spaced jets on the liquid-barrier properties of the resultant spunlaced fabrics are shown in FIG. 1 as a function of the jet spacing in the high pressure entanglement treatment and in FIG. 2 as functions of the jet spacing in the subsequent finishing treatment.

DETAILED DESCRIPTION OF PREFERRED EMBODIMENTS

The key finding on which the present invention is based in that the liquid barrier properties of woodpulp-polyester spunlaced fabrics are significantly increased when the columnar water jets that are used in the manufacture of the fabric are more closely spaced than the jets had been spaced in the manufacturing processes used heretofore.

In prior art hydraulic entanglement treatments of woodpulp-polyester fiber assemblies, almost all (e.g., 95% or more) of the energy-impact product (E×I) was contributed by high pressure jets, which had spacings of 40 jets/in (15.7/cm) or fewer. As used herein, high pressure jets are those that operate with orifice supply pressures of at least 500 psi (3450 kPa) and usually at pressures of at least 1000 psi (6890 kPa). The prior art treatment was frequently completed with a pass under orifice banks operating with supply pressures of 300 psi (2070 kPa) and providing 60 jets/in (23.6/cm) width of fabric being produced. The purpose of the lower pressure final treatment was to avoid loose fibers on the surface of the resultant fabrics. However, the liquid-barrier properties of such prior art fabrics are significantly inferior to those made with more closely spaced jets.

Figure 1:
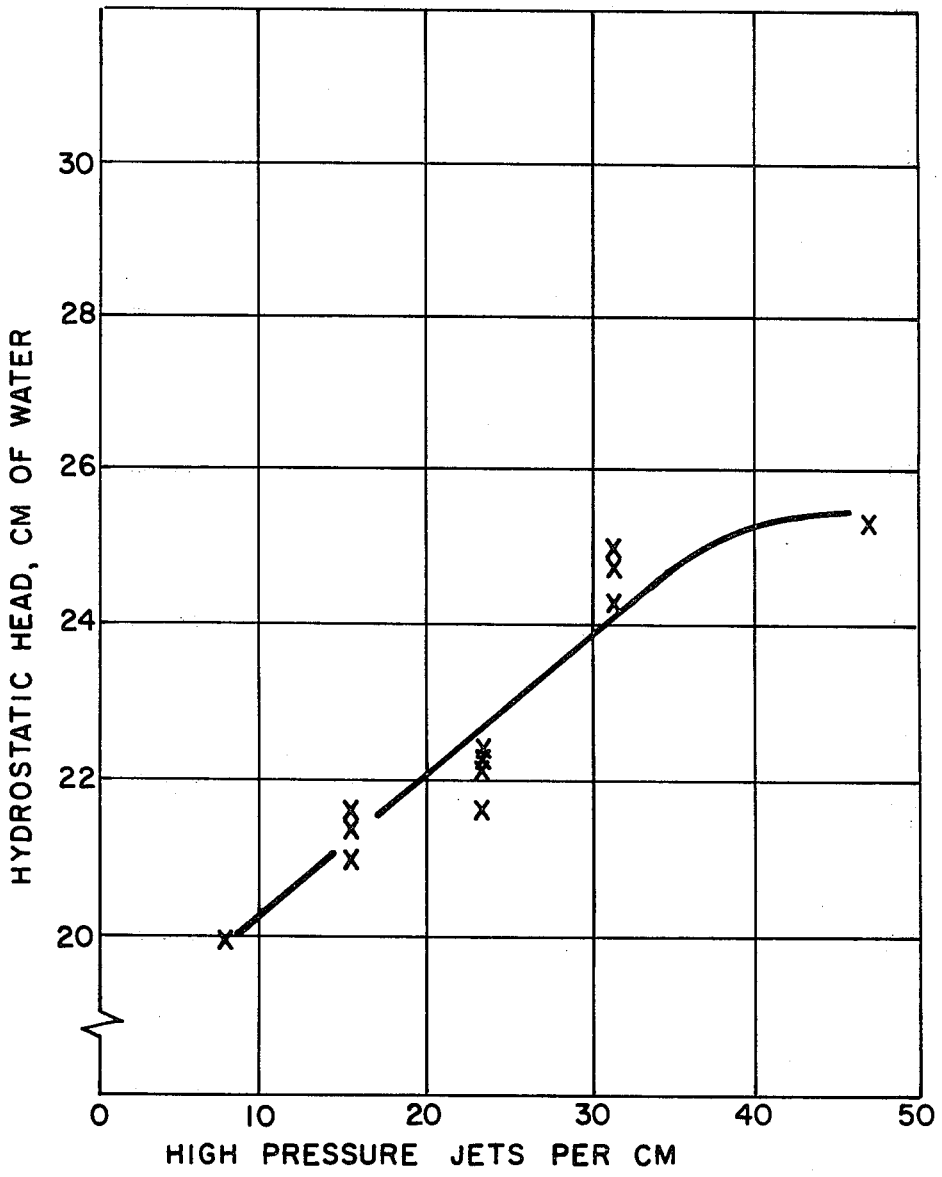

FIG. 1 shows the improvements that can be made in the liquid-barrier properties by using more closely spaced high pressure jets in the hydraulic entanglement treatment of woodpulp and polyester fiber assemblies. Note that if instead of using 40 high pressure jets/inch (15.7/cm), as in the prior art processes, 80 jets/in (31.5/cm) were employed, an improvement of about 14% in hydrostatic head would be attained. Even a small increase to only 60 high pressure jets/in (23.6/cm) would still result in a significant increase in hydrostatic head. The use of 120 high pressure jets/in (47.2/cm) would result in about a 20% improvement in hydrostatic head.

Figure 2:
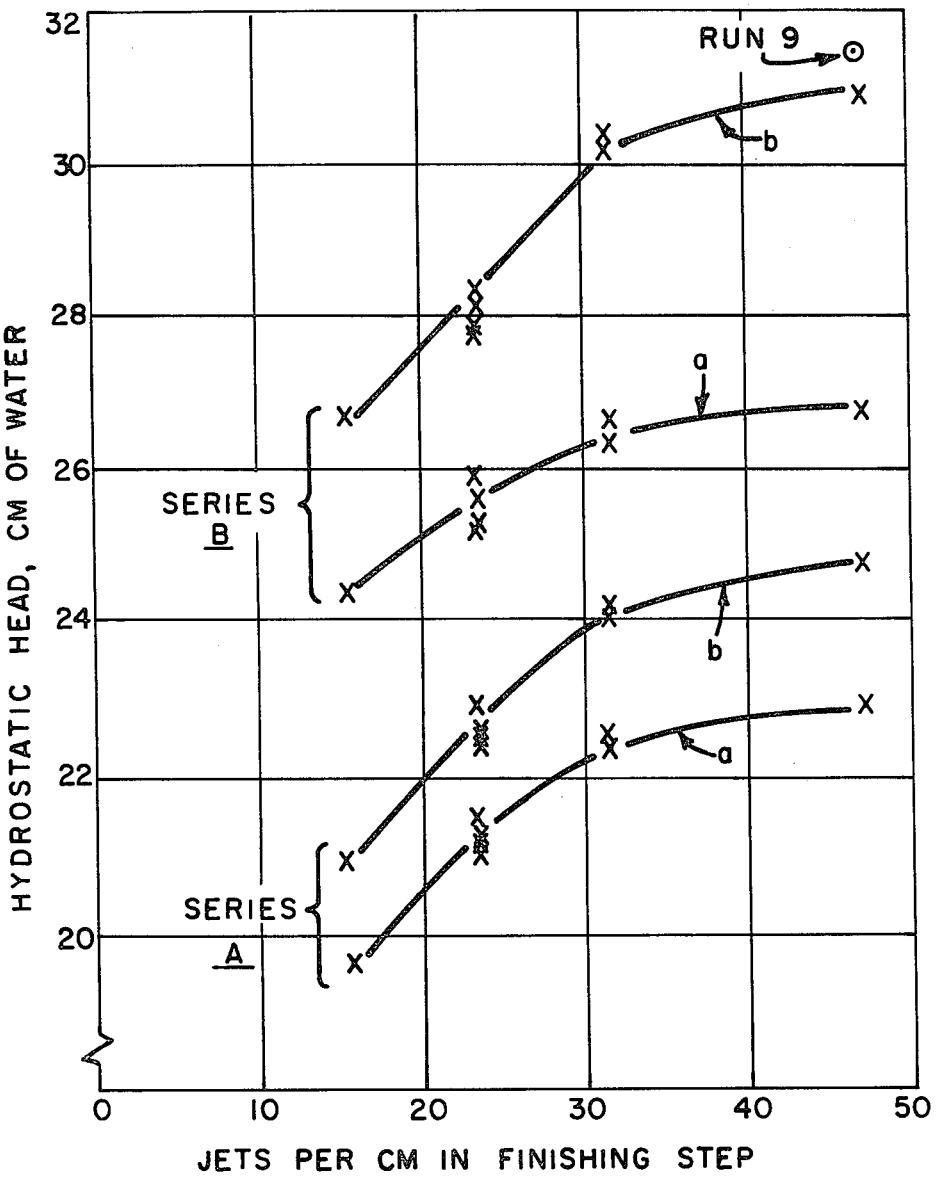

The beneficial effect of the use of more closely spaced high pressure jets on the hydrostatic head of the resultant spunlaced fabrics is also shown by comparing the corresponding curves of Series A and Series B in FIG. 2. The curves for Series A represent the use of 40 high pressure jets/inch (15.7/cm) and the curves for Series B represent the use of 80 high pressure jets/inch (31.5/cm). Improvements in hydrostatic head of about 25% can be attributed in this comparison to increases in the number of high pressure jets from 40/in (15.7/cm) to 80/in (31.5/cm).

FIG. 2 also shows the advantage in barrier properties that is obtained when the high pressure jet treatment is followed by a finishing step which employs low pressure jets (i.e., 100 psi [690 kPa]) that are closely spaced. Each of the curves of FIG. 2 shows that as the jets of the finishing step are brought closer together (i.e., increasing the number of jets per unit width), the hydrostatic head of the resultant fabric is increased. Further increases are achieved by utilizing a plurality of banks of low pressure jets in the finishing step. Thus, a woodpulp-polyester spunlaced fabric that was made with high pressure jets that numbered 80/inch (31.5/cm) followed by four banks of low pressure jets that numbered 120/inch (47.2/cm) had a hydrostatic barrier that exceeded that of a spunlaced fabric made with 40 high pressure jets/inch (15.7/cm) and one bank of 60 low pressure jets/in (23.6/cm) by about 45%. The obtaining of such improvements in the hydrostatic head of woodpulp-polyester spunlaced fabrics by the use of closer spaced jets in the manufacture of the fabric was completely unexpected and unpredictable from the prior art.

The data from which the graphs of FIGS. 1 and 2 were constructed are given in Examples 3 and 4, respectively.

From the above-discussed results and data contained in the other examples below, it was concluded that the liquid barrier properties of spunlaced woodpulp polyester fabrics could be increased by performing the hydraulic entanglement treatment (a) with closely spaced high pressure jets or (b) with closely spaced low pressure jets in a finishing step that follows the known prior art high pressure jet treatment or (c) with closely spaced high pressure jets and closely spaced low pressure finishing jets.

When high pressure jets are used without a finishing step, improvements in hydrostatic head of the fabric are obtained if at least one third of the total energy-impact product (E×I) of the hydraulic entanglement process is furnished through banks of orifices which provide at least 23 jets/cm (58.4/in). Preferably, the jets that provide at least this E×I have spacings in the range of 30 to 50 jets/cm (76 to 127 jets/inch). For higher hydrostatic heads, it is preferred that more of the E×I be contributed by the closer spaced jets.

When a finishing step is employed following a conventional high pressure jet treatment, the supply pressures in the finishing step usually do not exceed about 250 psi (1720 kPa) and preferably are in the range of 50 to 150 psi (345 to 1035 kPa). Also the finishing jets number at least 27/cm (68.6/in) and preferably number in the range of 30 to 50/cm (76 to 127/in). The finishing step adds less than 2% to the total E×I and usually less than 1%. For increasing the effects of the finishing step on barrier properties, it is preferred that the finishing step employ a plurality of banks of low pressure jets.

For further increases in hydrostatic head of the woodpulp-polyester spunlaced fabric, the preferred closely spaced high-pressure jet treatment (as described above) is followed by a preferred finishing step with low pressure closely spaced jets (as described above).

In the process of the invention, the closely spaced jets usually issue from banks of orifices. Generally, orifices having diameters in the range of 0.05 to 0.13 millimeters are satisfactory.

As used herein the term "fibers" may mean woodpulp fibers, polyester staple fibers or polyester filaments of any length. The term "fiber assembly" refers to the combination formed by the woodpulp fiber layer and polyester fiber layer. For use in the process of the present invention, it is convenient for the woodpulp and polyester fiber to be in the form of flat layers. Preferably, the woodpulp fibers are in the form of sheets of paper and the polyester fibers are in the form of an air-laid web of staple fibers or a nonwoven sheet of substantially continuous filaments. The webs or sheets may be bonded or nonbonded. Continuous filament nonwoven sheets are preferred for their ease of handling and their strength in light weights. For use in the present invention, the weight ratios of woodpulp to polyester generally are are in the range of 80:20 to 40:60, with preferred ratios being in the range of 65:35 to 50:50.

In making the nonapertured, nonwoven fabrics of the present inention by hydraulic entanglement, a woodpulp fiber layer is usually placed on top of the polyester fiber layer and the hydraulic jets start the entanglement process through the top woodpulp layer. Accordingly, the resultant spunlaced fabric is somewhat two-sided; one side having relatively more woodpulp near its surface than the other.

The nonapertured woodpulp-polyester spunlaced fabrics made by the above-described processes of the invention generally have lines of entangled fibers that can be seen by viewing the woodpulp-lean surface of the fabric under magnification. The number of lines per unit width, or jet tracks, correspond generally to the jet spacing employed with the highest pressure jets of the process. The spunlaced fabrics produced by the processes of the invention generally weigh less than 2.2 oz/yd$^2$ (75 g/m$^2$), exhibit at least 23 jet tracks per cm and have a hydrostatic head of at least 23 cm of water. Preferably, the novel fabrics have a hydrostatic head of at least 26 cm and at least 27 jet tracks per centimeter. Most preferably, the fabric has between 30 and 50 jet tracks per cm.

In each of the following examples, the following procedures, equipment and test methods were used, except where otherwise noted.

Woodpulp fibers were used in the form of 1.33 oz/yd$^2$(45.1 g/m$^2$) Harmac paper made from Western Red Cedar woodpulp.

Screens on which the fiber assemblies were supported during the treatment with hydraulic jets had a 21% open area, were of plain weave design having 100×96 wires per inch (39.3×37.8 wires/cm) and had about 12 to 15 inches (30 to 38 cm) of water suction maintained under the screen.

All orifices, except for those of Runs 1a and 1b of Example 4, were arranged in two staggered rows, such that they provided twice as many equally spaced jets across the width of the fiber assembly being treated as the number of orifices in each row. The distance between the staggered rows was 0.040 inch (0.10 cm). In Runs 1a and 1b of Example 4, the orifices were arranged in one single row.

Supply pressure was the gauge pressure measured immediately upstream of the orifice.

A water-repellant finish was padded onto each sample of spunlaced fabric and dried before the hydrostatic head of the sample was measured. The water repellant provided, based on total dry weight of the fabric, 1.2% of Zonyl® NWG fluoroalkyl methacrylate copolymer and 2.4% of TLF-5400, a reactive nitrogen compound (both sold by E. I. du Pont de Nemours and Company). The samples with padded on repellant were dried and cured at 180° C. for 5 minutes.

Grab tensile strength is reported for 1-inch (2.54-cm) wide strips of fabric. Machine direction (MD) and cross-machine direction (XD) measurements are made with an Instron machine by ASTM Method D-1682-64 with a clamping system having a 1×3 inch (2.54×7.62 cm) back face (with the 2.54 cm dimension in the vertical or pulling direction) and a 1.5×1 inch (3.81×2.54 cm) front face (with the 3.81 cm dimension in the vertical or pulling direction) to provide a clamping area of 2.54×2.54 cm. A 4×6 inch (10.16×15.24 cm) sample is tested with its long direction in the pulling direction and mounted between 2 sets of clamps at a 3-inch (7.62-cm) gauge length (i.e., length of sample between clamped areas). Break elongation values are measured at the same time.

Frazier porosity, a measure of the air permeability of the fabric, was determined by the method of ASTM-D-737-46.

Mullen burst was determined by the method of ASTM-D-1117.

Taber rating, which is a rating of the abrasion resistance of the surface of the fabric, was determined by the method of ASTM-D-1175-647. For these determinations, a rubber wheel, labelled S-36 (available from Teledyne Company), a rubber base, and a 250-gram load were used for 25 cycles. The ratings range from zero to five, with zero being for fabrics with very poor abrasion resistance and 5 for fabrics with excellent abrasion resistance. Ratings of greater than 2 were considered satisfactory.

Disentanglement resistance of fabric was measures in cycles by the Alternate Extension Test (AET) described by Johns & Auspos "The Measurement of the Resistance to Disentanglement of Spunlaced Fabrics," Symposium Papers, Technical Symposium, *Nonwoven Technology—Its Impact on the* 80's, INDA, New Orleans, La. 158–162 (March 1979).

Hydrostatic head was measured by the method of the American Association of Textile Colorists and Chemists 127-1977.

The number of jet tracks per unit width were counted under magnification of the fabric viewed from the polyester side of the fabric.

EXAMPLE 1

This example illustrates the invention with the manufacture of a woodpulp-polyester spunlaced fabric in which the starting polyester fiber material is in the form of a bonded, continuous filament, nonwoven sheet. This example also compares this fabric of the invention with one made from the same materials by conventional hydraulic entanglement techniques.

Two nonwoven webs, weighing about 0.6 oz/yd$^2$ (20.3 g/m$^2$), were prepared by the general techniques of Kinney, U.S. Pat. No. 3,388,992 from continuous filaments of 1.85 denier (2 dtex) of polyethylene terephthalate and polyethylene isophthalate in a ratio of 91:9 and self bonded at a temperature of 235° C. The webs were then placed on a fine mesh screen, covered with Harmac paper and forwarded at a speed of 26.5 yards/min (24 m/min) under banks of jets operating at the conditions listed in Table I. Note that for the fabric of the invention almost 85% of the total E×I is contributed by closely spaced jets (i.e., 80 per inch [31.5/cm]) in the initial part of the treatment and that the finishing jets contribute only 0.28% of the total E×I. The total energy-input product (E×I) for the example of the invention was 0.0286 Hp-hr lb$_f$/lb$_m$ (7.49×10$^5$ NJ/kg) and for the comparison 0.0295 (7.73×10$^5$). Table II lists properties of the two spunlaced fabrics that were produced. Note the 32% higher liquid-barrier properties of the fabric of the invention (i.e., hydrostatic head of 28.2 versus 21.3 cm of water).

TABLE I

JET TREATMENTS OF EXAMPLE 1

| Jet Bank No. | Orifice Diameter in (mm) | Number of Jets per in (cm) | Pressure psi (kPa) | % of Total E × I |
|---|---|---|---|---|
| 1 | 0.005 (0.127) | 40 (15.7) | 600 (4130) | 15.0 |
| 2 | 0.004 (0.102) | 80 (31.5) | 1300 (8960) | 84.8 |
| 3 | " | " | 100 (690) | 0.14 |
| 4 | " | " | 100 (690) | 0.14 |
| | | COMPARISON | | |
| 1 | 0.005 (0.127) | 40 (15.7) | 600 (4130) | 14.5 |
| 2 | " | " | 1200 (8270) | 81.7 |
| 3 | " | 60 (23.6) | 300 (2070) | 3.8 |

TABLE II

FABRICS OF EXAMPLE 1

| | Of Invention | Comparison Fabric |
|---|---|---|
| Unit weight oz/yd$^2$ (g/m$^2$) | 1.9 (64.4) | 1.9 (64.4) |
| Number of Jet Tracks per inch (per cm) | 80 (31.5) | 40 (15.7) |
| Grab Strength | | |
| MD, lb (N) | 23 (102) | 23 (102) |
| XD, lb (N) | 20 (89) | 16 (71) |
| Elongation | | |
| MD, % | 24 | 19 |
| XD, % | 57 | 52 |
| Frazier Porosity ft$^3$/min/ft$^2$ (m$^3$/min/m$^2$) | 26 (7.9) | 51 (15.5) |
| Mullen Burst psi (kPa) | 17 (120) | 13 (90) |
| Taber Rating | 2.7 | 2.8 |
| Disentanglement Resistance AET Cycles | 10 | 9 |
| Hydrostatic Head, cm | 28.2 | 21.3 |

EXAMPLE 2

This example illustrates the invention with the manufacture of woodpulp-polyester spunlaced fabrics made with the polyester fibers in the form of an air-laid staple fiber web and compares fabrics made in accordance with the invention with a commercial spunlaced fabric which was made with widely spaced jets, as used heretofore.

Polyester staple fibers having a denier of 1.35 (1.5 dtex) and a length of 0.85 inch (2.2 cm) were made into a 0.83-oz/yd$^2$ (28.1-g/m$^2$) web by an air-laydown process of the type described in Zafiroglu, U.S. Pat. No. 3,797,074. Then, in a continuous operation, the web was placed on a screen of the same design as in Example 1, covered with Harmac paper as in Example 1 to form a fiber assembly and then passed under a series of banks of jets, under the conditions as shown in Table III to form Fabrics A and B of the invention. The Comparison Run is in accordance with a previously used commercial practice.

As shown in Table III, Run A employs closely spaced jets (1) in banks 3–7 to perform the entanglement treatment and provide about 98% of the total I×E and (2) in banks 8 and 9 to perform a finishing treatment in accordance with the invention. In Run B, also according to the invention, the preferred finishing treatment is not used, but about 40% of the total E×I is contributed by closely spaced entangling jets in banks 6 and 8. In the comparison run, neither the closely spaced jets nor the finishing step were employed.

Comparison of the liquid-barrier characteristics of each of the fabrics showed that the fabric made in accordance with former commercial practice had a hydrostatic head of only 20.3 cm of water. The fabric of Run B had a hydrostatic head of 23.0 cm of water, an increase of more than 13% over that of the commercial fabric. Run A had a hydrostatic head of 27.8 cm of water, or an increase of 37% over the former commercial fabric.

TABLE III

JET TREATMENTS OF EXAMPLE 2

| Jet Bank No. | Orifice Diameter in (mm) | Number of Jets per in (cm) | Pressure psi (kPa) | % of Total E × I |
|---|---|---|---|---|
| | | Run A: Speed = 144 ypm (132 m/min) Total E × I = 0.0454 Hp-hr lb$_f$/lb$_m$ (11.9 × 10$^5$ NJ/kg) | | |
| 1 | 0.005 (0.127) | 40 (15.7) | 50 (345) | 0.003 |
| 2 | " | " | 400 (2700) | 0.6 |
| 3 | " | 60 (23.6) | 500 (3450) | 1.5 |
| 4 | " | " | 1400 (9650) | 19.9 |
| 5 | " | " | 1800 (12,400) | 37.3 |
| 6 | 0.004 (0.102) | 80 (31.5) | 1800 (12,400) | 20.4 |
| 7 | " | " | 1800 (12,400) | 20.4 |
| 8 | " | " | 100 (690) | 0.02 |
| 9 | " | " | 100 (690) | 0.02 |
| | | Run B: Speed = 155 ypm (142 m/min) Total E × I = 0.0557 Hp-hr lb$_f$/lb$_m$ (14.6 × 10$^5$ NJ/kg) | | |
| 1 | 0.005 (0.127) | 40 (15.7) | 100 (690) | 0.01 |
| 2 | " | " | 400 (2760) | 0.4 |
| 3 | " | " | 700 (4820) | 1.7 |
| 4 | " | " | 1500 (10,340) | 11.3 |
| 5 | " | " | 2000 (13,780) | 23.2 |
| 6 | " | 60 (23.6) | 1600 (11,020) | 19.9 |
| 7 | " | 40 (15.7) | 2000 (13,780) | 23.2 |
| 8 | " | 60 (23.6) | 1600 (11,020) | 19.9 |
| 9 | " | " | 300 (2070) | 0.3 |
| | | Comparison: Speed = 138 ypm (126 m/min) Total E× I = 0.052 Hp-hr lb$_f$/lb$_m$ | | |

TABLE III-continued

| JET TREATMENTS OF EXAMPLE 2 | | | | |
|---|---|---|---|---|
| Jet Bank No. | Orifice Diameter in (mm) | Number of Jets per in (cm) | Pressure psi (kPa) | % of Total E × I |
| | | (13.6 × $10^5$ NJ/kg) | | |
| 1 | 0.005 (0.127) | 40 (15.7) | 100 (690) | 0.02 |
| 2 | " | " | 400 (2760) | 0.5 |
| 3 | " | " | 700 (4820) | 2.2 |
| 4 | " | " | 1800 (12,400) | 23.5 |
| 5 | " | " | 1800 (12,400) | 23.5 |
| 6 | " | " | 1800 12,400) | 23.5 |
| 7 | " | " | 1900 (13,090) | 26.8 |
| 8 | " | 60 (23.6) | 300 (2070) | 0.2 |

TABLE IV

| FABRICS OF EXAMPLE 2 | Run A | Run B | Comparison |
|---|---|---|---|
| Unit weight oz/yd$^2$(g/m$^2$) | 2 (68) | 2 (68) | 2 (68) |
| Number of jet tracks per in (per cm) | 80 (31.5) | 60 (24) | 40 (16) |
| Grab strength | | | |
| MD, lb (N) | 40.5 (180) | 35.5 (158) | 36 |
| XD, lb (N) | 21.8 (97) | 18.6 (83) | 20 |
| Elongation | | | |
| MD, % | 26 | 23 | n.m. |
| XD, % | 79 | 76 | n.m. |
| Frazier Porosity ft$^3$/min/ft$^2$ (m$^3$/min/m$^2$) | 60 (18) | 89 (27) | 87 (27) |
| Mullen Burst psi (kPa) | 54 (370) | 45 (310) | 45 (310) |
| Taber Rating | 2.7 | 2.6 | 2.2 |
| Disentanglement Resistance AET Cycles | 12 | 9 | n.m. |
| Hydrostatic Head, cm | 27.8 | 23.0 | 20.3 |

*n.m. means not measured

The advantage of using 30 to 50 jets/cm is even more striking. In the past 15.7 jets/cm (40/in) had been used to make woodpulp-polyester spunlaced products.

TABLE V

| OPERATION OF JET BANKS IN EXAMPLE 3 | | | | |
|---|---|---|---|---|
| Run No. | Orifice Diameter in (mm) | Number of Jets per in (cm) | Supply Pressure in Successive Headers psi (kPa) | Hydro-Static Head cm |
| 1 | 0.005 (0.127) | 20 (7.9) | 1300, 1600 [2X]* (8960, 11020 [2X]) | 19.9 |
| 2 | " | 40 (15.7) | 1800, 1600 (6890, 11020) | 21.0 |
| 3 | " | 60 (23.6) | 1500 (10340) | 22.1 |
| 4 | " | 80 (31.5) | 1350 (9310) | 24.7 |
| 5 | 0.004 (0.102) | 40 (15.7) | 700, 1600 3X) (4820, 11020 ]3X]) | 21.6 |
| 6 | " | 60 (23.6) | 900, 1500, 1600 (6200, 10340, 11020) | 22.4 |
| 7 | " | 80 (31.5) | 1300, 1600 (8960, 11020) | 25.0 |
| 8 | " | 120 (47.2) | 850, 1500 (5860, 10340) | 25.3 |
| 9 | 0.003 (0.076) | 40 (15.7) | 1000, 1400, 1600 [9X] (6890, 9650, 11020 [9X]) | 21.4 |
| 10 | " | 60 (23.6) | 1300, 1600 [6X] (8960, 11020 [6X]) | 22.3 |
| 11 | " | 80 (31.5) | 1000, 1400, 1600 [4X] (6890, 9650, 11020 [4X]) | 24.3 |
| 12 | 0.002 (0.051) | 60 (23.6) | 1000, 1400, 1600, [33X] (6890, 9650, 11020 [33X]) | 21.6 |

*Indicates the numbers of passes at the immediately preceding listed pressure.

EXAMPLE 3

This example demonstrates the beneficial effects of using closely spaced jets in the hydraulic entanglement of woodpulp and polyester fibers to obtain spunlaced fabrics of improved liquid-barrier properties.

The continuous polyester filament sheets and Harmac paper of Example 1 are formed into a fiber assembly as in Example 1. Only the self-bonding temperature of the polyester sheet was different, 170° C. instead of 235° C. Then, with the same equipment as in Example 1, the fiber assembly was forwarded at a speed of 70 yards/min (64 m/min) under a series of banks of jets. A total of twelve runs was made. In each run, the first bank of jets contained 40 per inch (15.7/cm), had 0.005-inch (0.127-cm) diameter orifices and supply pressures of 500 psi (3450 kPa). The last bank of jets in each run had 60 jets per inch (23.6/cm), 0.005-inch (0.127-cm) diameter orifices and 300 psi (2070 kPa) supply pressures. After passage under the jets, the wet fabric was passed between a pair of 2¼ inch (5.7 cm) diameter stainless steel squeeze rolls to remove excess water and the fabric was allowed to dry. The orifice sizes, jet spacings and pressures used in the intermediate banks of jets are shown in Table V and were selected to give a constant total E×I of 0.025 Hp-hr $lb_f/lb_m$ (6.5×$10^5$ NJ/kg). Also recorded in Table V is the hydrostatic head of each of the resultant spunlaced fabrics.

The results of these tests are plotted in FIG. 1. This figure shows the advantageous increase in hydrostatic head that is obtained when at least 28.5 jets per centimeter are used in the hydraulic entanglement treatment.

EXAMPLE 4

This example shows the gain in barrier properties that are obtained when woodpulp-polyester spunlaced fabrics are made with closely spaced jets in the initial high-pressure entanglement treatment and/or in the following low-pressure step. The example also demonstrates the superior barrier properties of such spunlaced fabrics made in accordance with the present invention, rather than with more widely spaced jets as were conventionally used heretofore.

Continuous polyester filament nonwoven sheet and Harmac paper, as were used in Example 3, were hydraulically entangled at the same speed and with the same equipment as in Example 3. Two series of runs were made under the high pressure jet entanglement conditions summarized in Tables VI and VII. The conditions for the high pressure jets of the entanglement treatment, namely the jets of the first three banks of jets, are given in Table VI. In Series A, the high pressure jets are conventionally spaced. In Series B, closely spaced high pressure jets are employed. The conditions for the jets of the finishing step are given in Table VII. The supply pressure for all jets in each of the finishing step was 100 psi (600 kPa). Part (a) of each run included a one-pass finishing step; part (b), a four-pass finishing step. The jets of the finishing step added less than 0.4% to the total E×I of the whole treatment. The total E×I for each run was maintained at 0.025 Hp-hr $lb_f/lb_m$ (6.5×$10^5$ NJ/kg).

The hydrostatic head of each fabric produced in each run was measured. The results are recorded in Table VII and presented graphically in FIG. 2. Curves "a" represent the fabrics produced with the one-pass finishing step and Curves "b" represent the fabrics produced with the four-pass finishing step. The lower two curves are for the fabrics of Series A, and the upper two curves are for the fabrics of Series B.

The highest hydrostatic head recorded in Table VII is 30.9 cm for Run 8b. However, even higher values were obtained when even closer spaced jets were used in another test, Run 9. Run 9 was performed under the same conditions as Run 8b except that the orifices of banks 2 and 3 provided 120 jets per inch (47.2/cm), and operated with supply pressures of 850 and 1500 psi (5860 and 10,340 kPa), respectively. The total E×I was still 0.025 Hp-hr $lb_f/lb_m$ ($6.5\times10^5$ NJ/kg). The hydrostatic head of the fabric produced in Run 9 was 31.4 cm. This point is labelled "Run 9" in FIG. 2.

The sharp contrast between the liquid barrier characteristics of spunlaced fabrics produced according to the invention and those of spunlaced fabrics prepared with the commonly used wider spaced jets of known hydraulic entanglement treatments can be clearly seen from FIG. 2. The lower two curves, which represent Series A were made with conventionally spaced high pressure jets; namely, 40 per inch (15.7/cm). Note that even when a low-pressure jet finishing step is performed with finishing jets of spaced at 60 per inch (23.6/cm), hydrostatic heads of less than about 22.5 cm generally were obtained. However, increases in hydrostatic head to almost 25 cm were obtained when the finishing jets were more closely spaced and multiple passes were employed (curve b of Series A).

The full increase in barrier properties which is attainable with the use of closely spaced jets in both the high pressure jet entanglement treatment and the low pressure finishing step is shown by the upper two curves (Series B) of FIG. 2. The use of a multiple pass finishing step permitted the attainment of hydrostatic barriers of over 30 cm, or as much as 50% greater than that obtained with conventionally spaced jets and no finishing step.

TABLE VI

HIGH PRESSURE JET TREATMENT OF EXAMPLE 4

| Jet Bank No. | Orifice Diameter in (mm) | Number of Jets per in (cm) | Supply Pressure psi (kPa) | % of Total E × I |
|---|---|---|---|---|
| | Series A: Conventional Jet Spacing | | | |
| 1 | 0.005 (0.127) | 40 (15.7) | 500 (3450) | 4 |
| 2 | " | " | 1000 (6890) | 23 |
| 3 | " | " | 1600 (11,020) | 73 |
| | Series B: Close Jet Spacing | | | |
| 1 | 0.005 (0.127) | 40 (15.7) | 500 (3450) | 4 |
| 2 | 0.004 (0.102) | 80 (31.5) | 1300 (8960) | 36 |
| 3 | " | " | 1600 (11,020) | 60 |

TABLE VII

FINISHING STEP OF EXAMPLE 4

| Run No. | Orifice Diameter in (mm) | Number of Jets per in (cm) | % of Total E × I | Hydrostatic Head cm of Water Series A | Series B |
|---|---|---|---|---|---|
| 1a | 0.004 (0.102) | 40 (15.7) | 0.03 | 19.6 | 24.4 |
| 1b | " | " | 0.10 | 20.9 | 26.7 |
| 2a | 0.002 (0.051) | 60 (23.6) | 0.003 | 21.0 | 25.9 |
| 2b | " | " | 0.01 | 22.5 | 28.4 |
| 3a | 0.003 (0.076) | " | 0.014 | 21.5 | 25.6 |
| 3b | " | " | 0.05 | 22.9 | 28.2 |
| 4a | 0.004 (0.102) | " | 0.04 | 21.6 | 25.3 |
| 4b | " | " | 0.16 | 22.6 | 27.9 |
| 5a | 0.005 (0.127) | " | 0.11 | 21.3 | 25.2 |
| 5b | " | " | 0.39 | 22.5 | 27.8 |

TABLE VII-continued

FINISHING STEP OF EXAMPLE 4

| Run No. | Orifice Diameter in (mm) | Number of Jets per in (cm) | % of Total E × I | Hydrostatic Head cm of Water Series A | Series B |
|---|---|---|---|---|---|
| 6a | 0.003 (0.076) | 80 (31.5) | 0.02 | 22.5 | 26.6 |
| 6b | " | " | 0.07 | 24.2 | 30.4 |
| 7a | 0.004 (0.102) | " | 0.06 | 22.4 | 26.3 |
| 7b | " | " | 0.21 | 24.0 | 30.2 |
| 8a | " | 120 (47.2) | 0.09 | 22.9 | 26.7 |
| 8b | " | " | 0.31 | 24.7 | 30.9 |

What is claimed is:

1. In a process for producing a nonapertured spunlaced nonwoven fabric from an assembly consisting essentially of woodpulp and synthetic organic fibers wherein the assembly, while on a supporting member is treated with fine, columnar jets of water which issue from banks of orifices having diameters in the range of 0.05 to 0.13 millimeters and provide a sufficient total energy-impact product (E×I) to entangle the fibers and form them into the spunlaced fabric, the improvement which comprises for increasing the liquid-barrier characteristics of the fabric, performing the entanglement treatment with at least one third of the total E×I being furnished through orifice banks having orifice supply pressures of at least 6900 kPa and providing at least 23 jets per centimeter of fiber assembly being treated.

2. A process of claim 1 wherein the jets furnishing at least one third of the total E×I have spacings in the range of 30 to 50 jets/cm.

3. A process of claim 1 wherein the fiber assembly is prepared from fibers in the form of continuous filament nonwoven sheet and the woodpulp fibers in the form of paper sheet.

4. A process of claim 1, 2 or 3 wherein the entanglement treatment is followed by a finishing step that employs hydraulic jets that add less than two percent to the total E×I and have orifice supply pressures of less than 1720 kPa.

5. A process of claim 4 wherein the finishing step utilizes a plurality of banks of finishing jets which have orifice supply pressures in the range of 345 to 1035 kPa and jet spacings in the range of 30 to 50 jets/cm.

6. In a process for producing nonapertured spunlaced nonwoven fabric from an assembly consisting essentially of woodpulp and synthetic organic fibers wherein the assembly, while on a supporting member, is treated with fine columnar jets of water which issue from banks of orifices having diameters in the range of 0.05 to 0.13 millimeters and provide sufficient total energy-impact product (E×I) to entangle the fibers and form them into the spunlaced fabric, the improvement, which comprises, for increasing the liquid-barrier characteristics of the fabric, following the entanglement treatment with a finishing step that employs hydraulic jets which add no more than 2% to the total E×I, have orifice supply pressures of less than 1720 kPa and have jet spacings of at least 27 jets/cm.

7. A process of claim 6 wherein the finishing step utilizes a plurality of orifice banks which have supply pressures in the range of 345 to 1035 kPa and provide jet spacings in the range of 30 to 50 jets per cm.

8. In a nonapertured, spunlaced nonwoven fabric consisting essentially of woodpulp and synthetic organic fibers and weighing less than 75 g/m², the improvement comprising the fabric having a hydrostatic head of at least 23 cm and at least 23 jet tracks per centimeter.

9. A fabric of claim 8 having a hydrostatic head of at least 26 centimeters and at least 27 jet tracks per centimeter.

10. A fabric of claim 8 or 9 having between 30 and 50 jet tracks per centimeter.

* * * * *